US005577622A

United States Patent [19]

Kapteyn

[11] Patent Number: 5,577,622

[45] Date of Patent: Nov. 26, 1996

[54] MERCHANDISING DISPLAY RACK ASSEMBLY

[75] Inventor: Bruce B. Kapteyn, Lake Oswego, Oreg.

[73] Assignee: Van Bloem, Inc., Alpharetta, Ga.

[21] Appl. No.: 502,429

[22] Filed: Jul. 14, 1995

[51] Int. Cl.[6] ..... A47F 3/14

[52] U.S. Cl. ..... 211/132; 211/149; 211/195; 211/201

[58] Field of Search ..... 211/132, 133, 211/126, 149, 186, 189, 195, 201

[56] References Cited

U.S. PATENT DOCUMENTS

| | | | |
|---|---|---|---|
| Re. 16,234 | 12/1925 | Taylor | 211/186 X |
| 908,000 | 12/1908 | Herbin . | |
| 1,100,072 | 6/1914 | Hammond . | |
| 1,304,847 | 5/1919 | Blais et al. . | |
| 1,319,130 | 10/1919 | Weston | 211/186 X |
| 1,612,903 | 1/1927 | Bitney | 211/133 X |
| 1,895,535 | 1/1933 | Brecht . | |
| 2,146,421 | 2/1939 | Davidson | 206/44 |
| 2,322,748 | 6/1943 | Shaw et al. | 211/126 X |
| 3,664,513 | 5/1972 | Atwater | 211/134 |
| 3,802,574 | 4/1974 | Weider | 211/134 |
| 4,022,328 | 5/1977 | Toland et al. | 211/149 |
| 4,274,613 | 6/1981 | Taub | 248/150 |
| 4,411,382 | 10/1983 | Taub | 229/16 |
| 4,582,283 | 4/1986 | Schmitt | 248/174 |
| 4,591,047 | 5/1986 | March | 206/5 |
| 4,651,883 | 3/1987 | Gullett et al. | 211/149 X |
| 5,000,329 | 3/1991 | Luberto | 211/132 |
| 5,042,651 | 8/1991 | Davis et al. | 211/132 |
| 5,131,547 | 7/1992 | Goldberg | 211/149 |
| 5,161,699 | 11/1992 | Hanna et al. | 211/132 |

*Primary Examiner*—Alvin C. Chin-Shue
*Assistant Examiner*—Michael J. Turgeon
*Attorney, Agent, or Firm*—Eugene D. Farley

[57] ABSTRACT

A merchandise display rack assembly. The assembly comprises in combination at least one box having an open top for containing merchandise to be displayed in a supporting rack. The rack includes spaced box-support bars arranged to provide a crib for reception of the box with its defining walls in bearing engagement with the bars and its open top canted forwardly for customer viewing and personnel access.

9 Claims, 3 Drawing Sheets

MERCHANDISING DISPLAY RACK ASSEMBLY

BACKGROUND OF THE INVENTION

This invention relates to a display rack assembly for merchandising various articles of commerce displayed in boxes having open tops.

It is the general purpose of the present invention to provide a display rack for use in merchandising articles such as flower bulbs in the open top boxes in which they are transported and stored. This is done in such a manner that the boxes themselves become the shelves of the rack. The boxes are canted obliquely to render the contents readily visible to the customer for inspection and readily accessible to the clerk for removal upon each sale.

Other objects of the present invention are the provision of a merchandising display rack assembly which may be collapsed for storage; which is braced against collapse when in its open, use position; which mounts the boxes securely; which has provision at its top for display advertising; and which is of simple construction, inexpensive to manufacture, and easy to use.

SUMMARY OF THE INVENTION

The merchandising rack assembly which achieves the foregoing and other objects broadly comprises in combination one or a plurality of display boxes having openable tops, and a rack for mounting the same.

The rack comprises two pairs of horizontally spaced support posts and at least one pair of front and back horizontally spaced box support bars. Bar support means secure the bars to the posts.

Also included in the assembly are a pair of post spacer subassemblies and securing means for securing the same to the posts. The arrangement is such that the bars and spacer subassemblies provide a crib dimensioned for reception of the box with its component walls in bearing engagement with the bars and with its openable top canted forwardly for customer viewing and manipulation of the box contents.

THE DRAWINGS

DESCRIPTION OF A PREFERRED EMBODIMENT OF THE INVENTION

As indicated above, the present invention comprises the combination of a box, indicated generally at 10, and a rack structure, indicated generally at 12, for displaying the box in such a manner as to display the contents thereof and make the contents easily available for dispensing.

Figure 1:
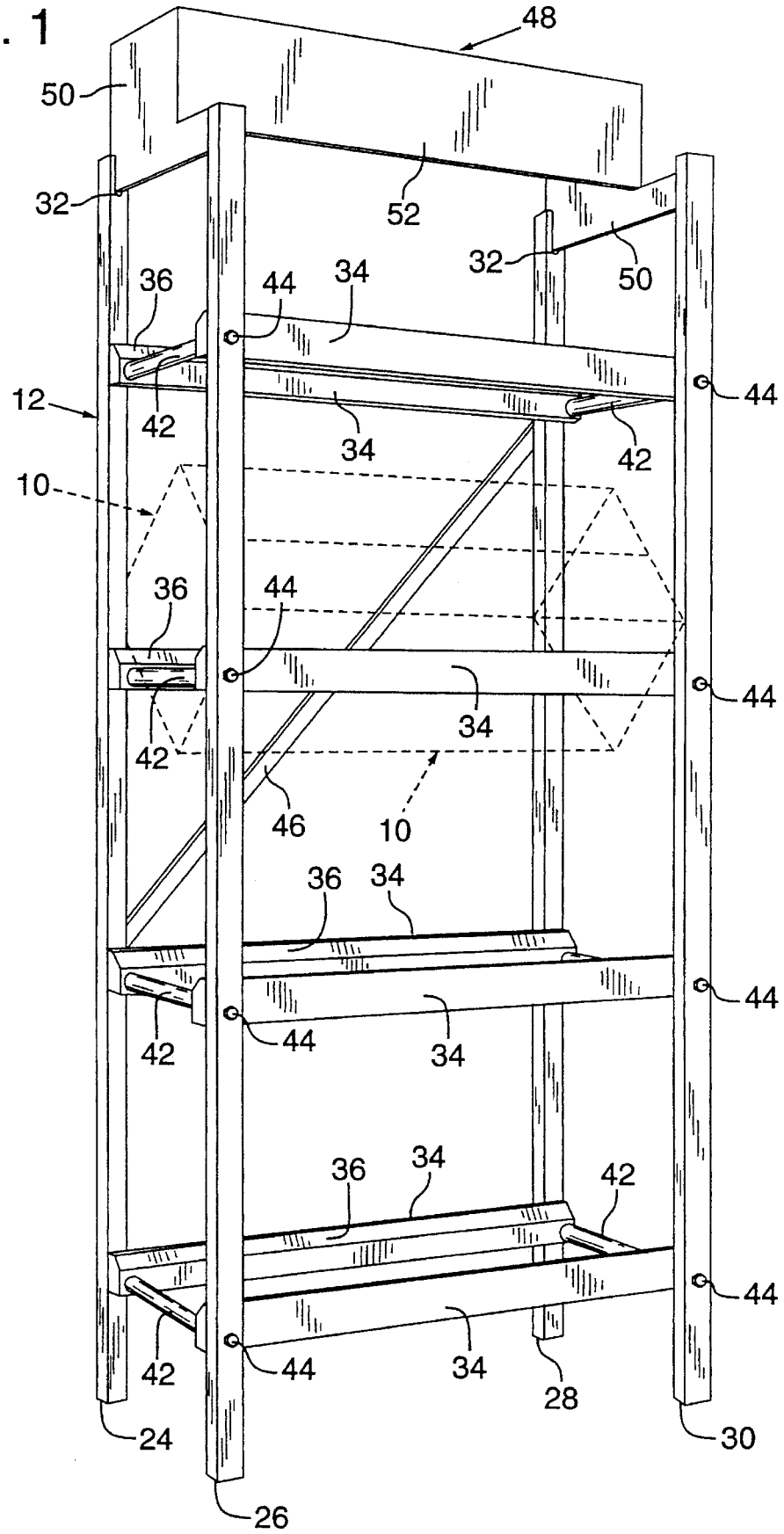
FIG. 1 is a perspective view of the herein described display rack assembly.
Figure 4:
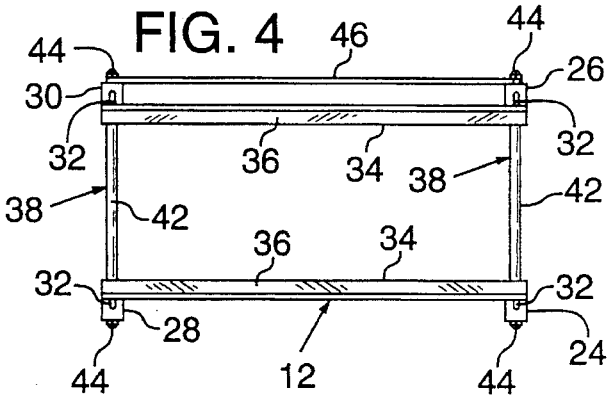
FIG. 4 is a top plan view of the assembly.
Figure 5:
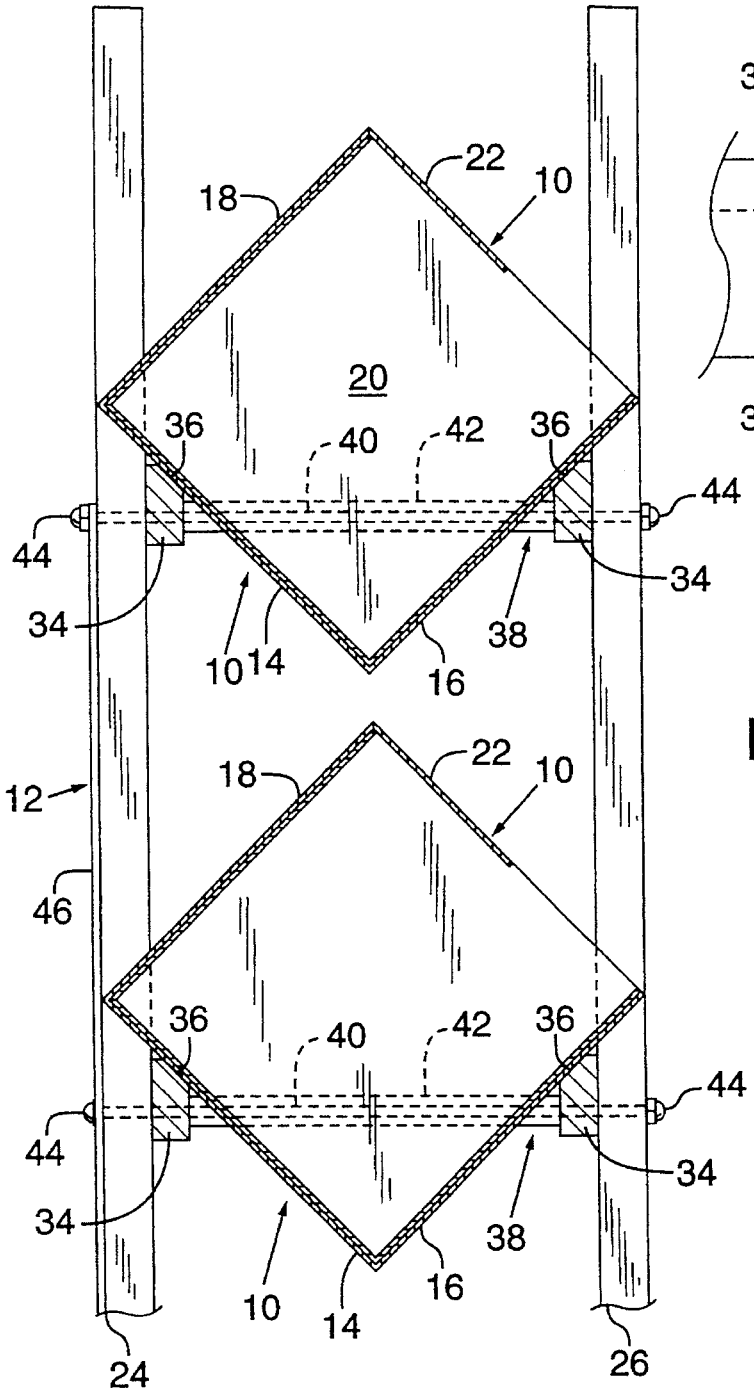
FIG. 5 is an enlarged fragmentary sectional view taken along line 5—5 of FIG. 2.
Figure 6:
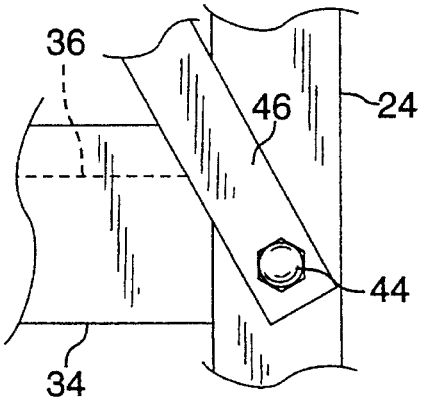
FIG. 6 is a fragmentary, detail view looking in the direction of the arrows of line 6—6 of FIG. 3.
Figure 7:
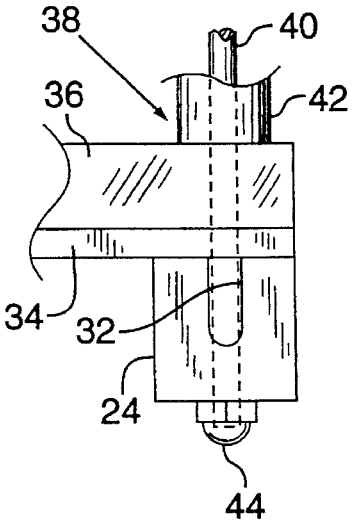
FIG. 7 is a fragmentary, detail view looking in the direction of the arrows of line 7—7 of FIG. 2.

In the illustrated form of the invention, FIGS. 1 and 5, box 10 is of the class employed for storing, transporting and merchandising various articles of commerce, in particular flower bulbs such as tulip bulbs, lily bulbs and the like. It is constituted of heavy duty corrugated paper board and includes a bottom wall 14, a front wall 16, a back wall 18, a pair of end walls 20 and an openable top closure 22.

The rack support for the box in its illustrated embodiment includes two pairs of upright support posts 24, 26 and 28, 30, FIG. 1. These are arranged in a spaced, rectangular arrangement. Each post has in its top an inwardly facing, centrally located, slot 32.

Associated with the posts are one or more crib structures arranged for supporting one or more boxes 10 in a display attitude. To this end there are provided one or more pairs of horizontally spaced, preferably substantially coplanar, box support bars 34. Each pair of the bars has opposed beveled upper surfaces 36 conforming to the contour of the box they are designed to support.

Also provided are post spacer subassemblies indicated generally at 38. In addition to their post spacing function, these elements of the assembly serve the important secondary function of securing support bars 34 to the support posts.

As shown particularly in FIG. 5, each spacer subassembly 38 comprises a pin 40 mounting a sleeve 42 and terminating in threaded ends on which are threaded nuts 44, which secure the bars to the posts.

Figure 2:
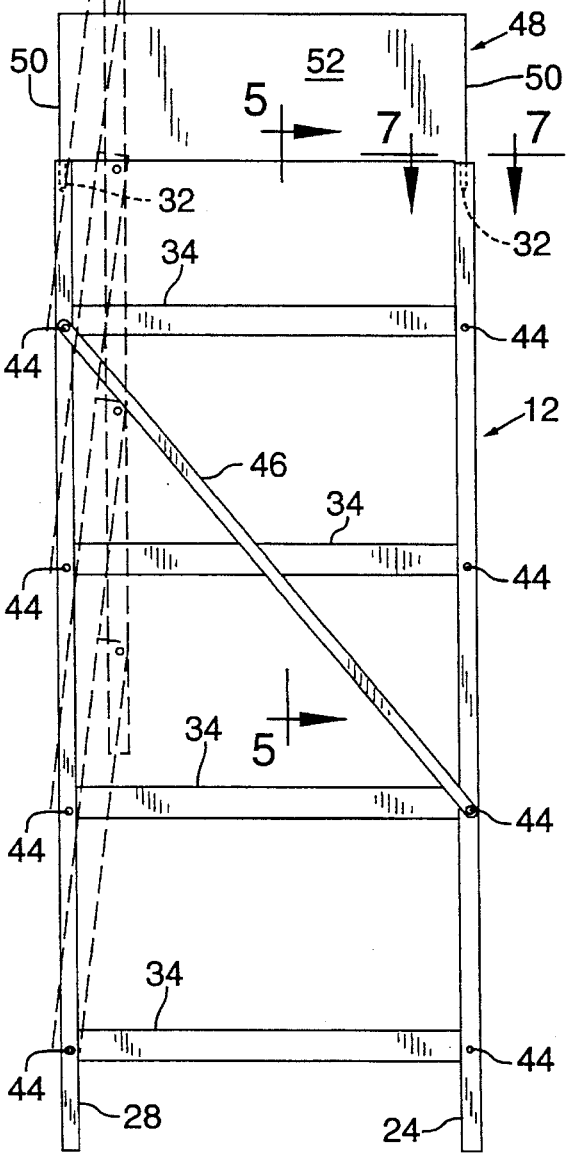
FIG. 2 is a view in back elevation of the assembly.

The spacer subassemblies also serve a third function: that of providing pin and sleeve type hinges which make possible shifting the rack structure between expanded use and collapsed storage positions, as indicated in the dashed outline of FIG. 2.

Figure 3:
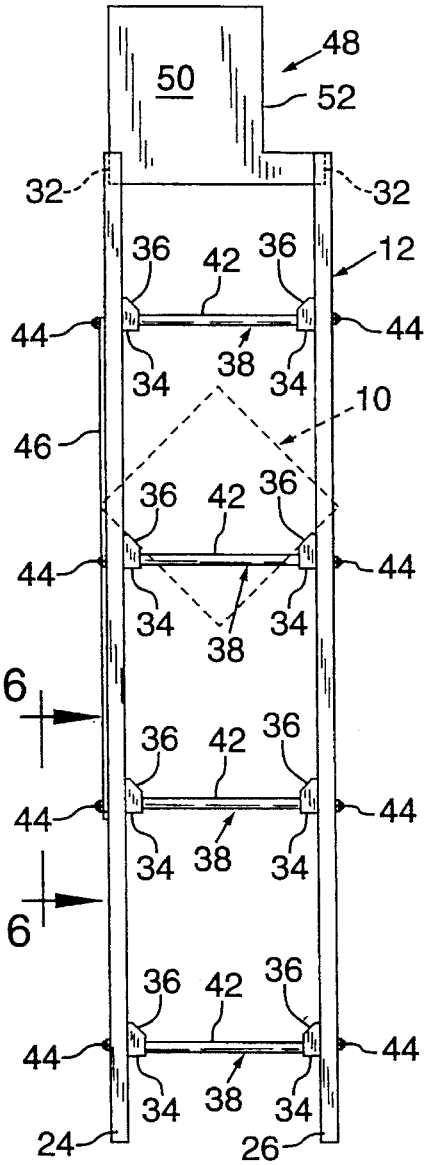
FIG. 3 is a view in a side elevation of the assembly.

Support bars 34 and spacers 38 define a crib having a central opening contoured and dimensioned to receive one of boxes 10 in nesting relation and in a canted or cocked position with its open top 22 facing upwardly in such a manner as to make its contents readily visible and accessible. FIGS. 3 and 5. When thus positioned, the box bottom wall 14 and its adjacent front wall 16 are in bearing engagement with the opposed beveled surfaces 36 of support bars 34, thus stabilizing the box in its use position.

Means are provided for stabilizing rack 12 and for ensuring that it does not collapse inadvertently if pushed or shoved when in use. As illustrated in FIGS. 1 and 2, such means comprise one or more diagonal braces 46 arranged as required to provide the desired degree of stability to the structure. Brace 46 is fabricated from a suitable rigid material such as wood or metal. As is shown particularly in FIG. 5, its ends are perforated for reception of the terminal portions of one of spacer pins 40 thereby mounting the brace in its operative position. It is to be noted that, as pointed out above, spacer pins 40 with associated sleeves 42 and nuts 44 serve four functions: that of providing a spacer for post pairs 24, 26 and 28, 30; that of providing a support for bars 34; that of providing a hinge to enable collapsing of the rack when not in use; and that of mounting brace 46 for rigidifying the structure when it is in use.

In addition to providing a support for boxes 10, rack 12 also serves the function of supporting a header indicated generally at 48. This may be inscribed or printed with advertising information and pictorial representations to attract the customer to the display and assist him in making his selection.

As illustrated particularly in FIG. 1, the header 48 comprises a flat sheet of cardboard or corrugated box board. The sheet is divided, as by scoring and folding, to provide a pair of end panels 50 and a central panel 52. End panels 50 are contoured in such a manner as to provide edge portions which are insertable in slots 32 in the upper ends of the supporting posts. There thus is provided a simple means for mounting the header, supporting it in a stable condition during use, and enabling its ready removal at a later date for storage or discard, as the case may be.

OPERATION

The manner of use of the herein described display rack assembly is as follows:

Assuming that the rack is in its collapsed, storage condition, it first is expanded to its use condition of FIG. 1. Brace 46 is put in place to secure the rack against inadvertent collapse.

The top panels 22 of boxes 10 are opened to display the contents. The boxes then are placed in the cribs provided by bars 34 and spacer subassemblies 38 in the canted manner illustrated in FIG. 5. In this position, the contents of the boxes are readily visible and readily available for sampling or dispensing.

Header 48 with advertising indicia printed thereon then is put in position at the top of the rack, completing the erection of the display. After its term of use has expired, the display may be dismantled by reversing the foregoing procedure.

Having thus described in detail a preferred embodiment of the invention, it will be apparent to those skilled in the art that various physical changes may be made without altering the inventive concepts and principles embodied. The present embodiments therefore are to be considered as illustrative and not restrictive, the scope of the invention being indicated by the appended claims.

I claim:

1. The merchandise display rack assembly comprising in combination a box having an openable top, side walls and a bottom for containing merchandise to be displayed, and a supporting rack therefor comprising:

a) two pairs of horizontally spaced support posts, b) a pair of front and back horizontally spaced box-support bars, c) bar support means for securing the bars to the posts, d) a pair of post spacers comprising pin and sleeve hinges, permitting folding of the rack during storage, and e) spacer-securing means engaging the pin components for securing the spacers to the posts, f) the bars and spacers being arranged to provide a crib dimensioned for nesting reception of the box with its bottom and a side wall in bearing engagement with the bars, and with its openable top canted forwardly for customer viewing of the box contents.

2. The display rack assembly of claim 1 wherein the bar and spacer pairs are substantially coplanar.

3. The display rack assembly of claim 1 including a plurality of cribs in vertically spaced relation to each other for the reception of a plurality of display boxes.

4. The display rack assembly of claim 1 wherein the boxes are of substantially rectangular cross section and the components of each pair of bars have opposed beveled upper surfaces to conform to the contour of the nesting box.

5. The display rack assembly of claim 1 wherein the pin components of the hinges comprise the support means for the bars.

6. The display rack assembly of claim 1 including brace means for bracing the posts against folding and brace means mounting means for releasably mounting the brace means diagonally between the post pairs.

7. The display rack assembly of claim 6 wherein the brace means mounting means comprises the pin components of the pin and sleeve hinges.

8. The display rack assembly of claim 1 wherein the posts have top ends and including an advertising header and header mounting means for mounting the header on the top ends of the posts.

9. The display rack assembly of claim 8 wherein the header comprises a piece of sheet material with advertising indicia thereon and the header mounting means comprises slots in the top ends of the posts dimensioned for reception of the piece in supporting engagement.

* * * * *